United States Patent [19]

Pifer

[11] 4,216,873

[45] Aug. 12, 1980

[54] CIGARETTE TRAY

[76] Inventor: Robert T. A. Pifer, 2218 Shoreham Dr., Durham, N.C. 27707

[21] Appl. No.: 901,584

[22] Filed: May 1, 1978

[51] Int. Cl.[2] ..... B65D 7/12; B65D 19/02

[52] U.S. Cl. ..... 220/4 R

[58] Field of Search ..... 220/4 R, 4 F

[56] References Cited

U.S. PATENT DOCUMENTS

| | | | |
|---|---|---|---|
| 1,023,577 | 4/1912 | De Maine | 220/4 F |
| 1,340,248 | 5/1920 | Petit | 220/4 F |
| 3,425,581 | 2/1969 | Pifer | 220/4 R |

*Primary Examiner*—George E. Lowrance
*Attorney, Agent, or Firm*—Mills and Coats

[57] ABSTRACT

In abstract a preferred embodiment of this invention is a tray type device for use in cigarette manufacturing facilities to hold cigarettes after manufacture and prior to packaging. This invention relates specifically to improved locking means for the lids of cigarette trays to prevent accidental disengagement of the lid from the tray and to assure proper positioning therebetween.

2 Claims, 2 Drawing Figures

CIGARETTE TRAY

FIELD OF INVENTION

This invention relates to the manufacture of tobacco products and more particularly to trays for holding cigarettes after manufacture and prior to packaging.

BACKGROUND OF INVENTION

In the manufacture of cigarette type smoking products, the most modern plants now have completely automated systems where the raw products are fed in and the final packaged products are cartoned for shipment. In addition to relative high initial equipment and installation cost, one of the big disadvantages of completely automatic systems is that when any portion malfunctions, the entire line must be shut down.

In view of the above, many cigarette manufacturers are still using the semi-automated manufacturing systems which have been in use for many years. These latter systems have generally included an automatic cigarette manufacturing machine and a separate automatic packaging machine so if one becomes in-operative, the other can continue to run. The cigarettes are transferred between the two systems by removing them from the cigarette manufacturing machine and placing them in a relatively large, thin, traylike magazine having a width the approximately length of a cigarette. A closure or lid is then placed on the open side of the tray and the same is transferred to the packaging machine where it acts as a magazine to feed the cigarettes.

Inherently in the transfer of the magazine trays, they are banged around, dropped and otherwise abused by the semi-skilled and unskilled labor hired to handle the same. The most abusive handling occurs during the return of the empty magazine trays from the package machine to the manufacture machine where blows to the unsupported center portion of the lid will bend the same inwardly causing the tray's post or cleat like securing means to become disengaged from the bracket portion of the lid. In an earlier attempt to overcome the problem of unintentional separation between the tray and the lid, a flat plate-like head was formed on the end of the pins. This innovation proved to be some improvement although the lid brackets still tend to become bent outwardly so they were difficult to engage and disengage because of binding against the plate-like head. Additionally, the cost of producing the enlarged headed pins increases the cost of the trays because they cannot be readily mass produced in that configuration.

SUMMARY OF INVENTION

Although the present Inventor was a Co-Inventor of the enlarged head innovation which is described in U.S. Pat. No. 3,425,581, he has continued to engage in research into the problems of securing cigarette tray lids to their respective trays so that regardless of the abuse received, they can still be readily engaged and disengaged. This research has culminated in a tobacco tray wherein the original, unheaded pins of the tray have been extended to prevent disengagement of the lid brackets when the central portion of the lid is compressed inwardly. Additionally, a lid-to-tray-edge engaging means is provided to give further assurance against unintentional lid-tray separation regardless of the amount of abuse the same receives. Because of the simplicity of the new combination lid to tray securing means, the two parts can be separated and reunited smoothly and effectively even after substantial damage has been sustained by either or both of the parts. additionally the tolerances of the improved securing means are not as critical as was necessary in the short pin or the enlarged head versions.

In view of the above, it is an object of the present invention to provide an improved cigarette tray to lid attaching means which will work smoothly and efficiently even after great abuse.

Another object of the present invention is to provide, in a cigarette tray to lid connecting means, a means for attaching the same at least four separate points.

Another object of the present invention is to provide a combination edge-to-side securing means for connecting a cigarette tray to its lid.

Another object of the present invention is to provide elongated pin means on a cigarette tray with hook like edge engaging means formed on the bracket of the lid thereby effective securing means at two separate locations at each end is provided.

Other objects and advantages of the present invention will become apparent and obvious from a study of the following description and the accompanying drawings which are merely illustrative of such invention.

DETAILED DESCRIPTION OF PREFERRED EMBODIMENT

Figure 1:
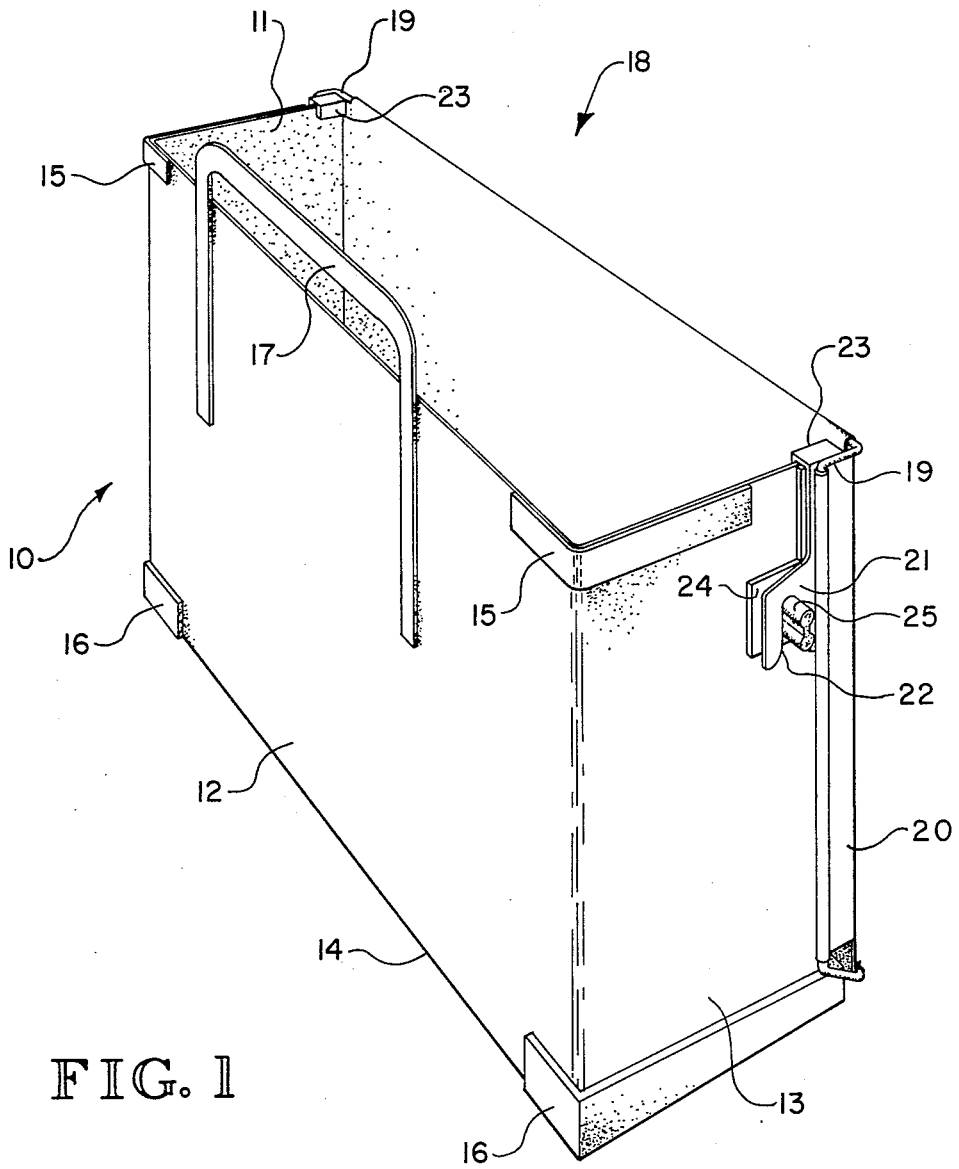
FIG. 1 is a perspective view of a cigarette tray and lid incorporating the securing means of the present invention.

With further reference to the drawings, a typical cigarette tray is indicated generally at 10 and includes three side walls 11, 12 and 13 and a bottom 14. Normal reinforcing flanges are provided as are magazine guide means 16 and a handle 17.

The lid indicated generally at 18 forms the fourth side of the magazine like container. This lid can be formed from metal of a similar gauge to tray 10 or, if desired, could be constructed from a suitable thickness of plexiglass. The lid shown is constructed of metal and includes the four edges being rolled with rod inserts 19 being provided as reinforcement.

Each end of lid 18 is formed in such a manner to provide a tray engaging flange 20 as seen clearly in FIG. 1.

Figure 2:
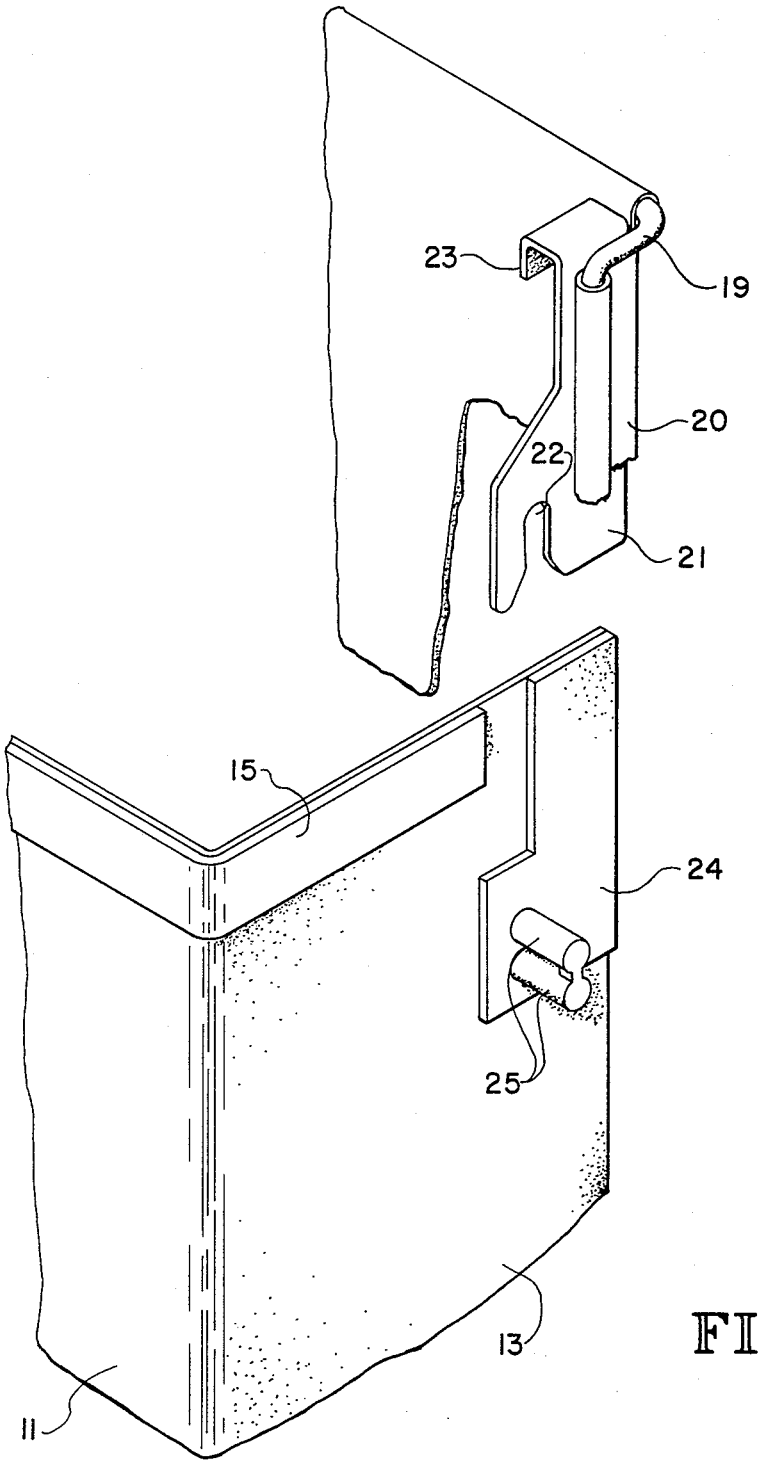
FIG. 2 is an exploded fragmentary view of such securing means.

Secured to the interior of flange 20 is a generally flat bracket 21. This bracket includes a cleat receiving slot 22 as seen clearly in the exploded view of FIG. 2. To the upper portion of bracket 21, as oriented in the drawings, is provided a flange-like side engaging hook portion 23.

A generally flat post or cleat supporting plate 24 is provided for each of the end-like side portions 11 and 13 adjacent the area adapted to receive lid 18. Exceptionally elongated post or cleat means 25 are fixedly secured at one end to plate 24 and outwardly extend perpendicular therefrom. Although one post would be adequate for holding the lid in place, the second post, as illustrated, reduces the tendency of the bottom of the lid (as oriented in the drawings) from loosely swinging outwardly away from tray 10. If desired one post could, of course, be used.

An advantage of the elongated pins or cleats 25, which have been unobvious to those skilled in the art until discovered during the experimentation and development of the present invention, is that when the center portion of lid 18 is inadvertently bowed inwardly, slot 18 in bracket 21 will twistingly bind on said post or cleat 25 with a holding effect that will prevent such bracket from slipping outwardly over the end of the post. Also unlike the flat headed post of the prior art, once the bowing or other bending pressures are to any substantial amount relieved, bracket 21 and post or cleat 25 can readily be disengaged.

The side engaging, hook-like flange 23 is preferably formed as an integral part of bracket 21. This flange, as can clearly be seen from the drawings, greatly aids in maintaining the cleat assembly, i.e., the cleat plate 24, bracket 21 and related parts, in connected retained relationship. When flanges 23 are engaged with the upper portions of walls 11 and 13, any amount of the bowing of top 18 will not affect the cleat assembly engagement. Should inadvertent upward movement of top 18 relative to tray 10 be accomplished to disengage flange 23, the lid and tray will be maintained by the relationship of bracket 21 and post 25 as hereinabove described. Because of the weight of lid 18, gravitational forces will tend to at all times maintain flange 23 in operative engagement with the upper portion of the ends of tray 10 thus assuring the operative connection between said lid and said tray. On the very rare occasions where the flange has been disengaged at either one or both ends of the tray, unless there has been an complete disengagement of slot 22 from post 25, the binding effect caused by the elongated post will still retain the relationship between the lid and the tray.

Finally, trays and lids are interchangeable. Because of the great abuse both lids and trays are subjected to, the prior known devices have encountered difficulties. The short post encountering warped brackets 21 which completely prevent securing engagement between the bracket slot and the cleat or post. The flat headed post, if the bracket 21 was the slightest bit out of alignment, would bind in the narrow tolerances between the post head and plate 24 thus causing difficulty which slows down the operation if it can be connected at all.

The present invention on the other hand, with only slight corrective bending or bowing pressures of either the lid or the end walls of tray, will allow quick and ready connection between the elongated posts 25 and slot and bracket 21 as well as engagement of the hook like flange ove the upper portion of the ends of the tray.

From the above, it can be seen that the present invention has the advantage of providing a simple, relatively inexpensive and yet highly efficient means for operatively retaining a lid relative to its associated cigarette tray. the structural features of this connecting means makes the connection between the two parts quick and easy to accomplish when either the tray, the lid or both are badly bent or otherwise abused.

The terms "upper", "lower", "top", "vertical", etc., have been used herein merely for convenience to describe the improved cigarette tray and its parts as oriented in the drawings. It is to be understood, however, that these terms are in no way limiting to the invention since the same may obviously be disposed in many different positions when in actual use or transport.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended Claims are intended to be embraced therein.

What is claimed is:

1. An improved device comprising: a cigarette tray having three abutting sides, a bottom, an open top and an open side; a pair of double, juxtaposed, headless, post like cleat means, each having a length equal to approximately twice its diameter secured one to each of the sides adjacent said open side in the area of said open top, each of said double cleat means being outwardly disposed generally vertically from its respective side means; a lid like closure for said open side including a tray engaging, flange like bracket with a generally vertical slot having a depth of greater extent than the combined diameters of said double posts in one edge thereof and being secured to said lid and disposed generally perpendicular thereto so as to lie generally juxtaposed to the exterior of the side walls adjacent said double cleat means whereby said slots will engage said cleats to releasably attach said lid to said tray; and an inwardly extending hook like flange means secured to said lid adjacent each of said slotted brackets for hookingly gripping the upper edge of said side adjacent said cleats when the same are in retaining engagement with said slots whereby said lid will remain connected to said tray even during extremely abusive handling.

2. The improvement of claim 1 wherein said double cleats are mounted on a plate like member which is secured to the respective sides of said tray.

* * * * *